United States Patent [19]

Tecco et al.

[11] 4,000,839

[45] Jan. 4, 1977

[54] SAFETY CLOSURE WITH REMOVABLE LID FOR CONTAINERS

[76] Inventors: Charles Tecco; William A. Loughley, both of c/o Weatherchem Corp., 2222 Highland Road, Twinsburg, Ohio 44087

[22] Filed: May 21, 1975

[21] Appl. No.: 579,468

[52] U.S. Cl. ..... 222/540; 222/545; 222/562; 215/321; 220/254; 220/284

[51] Int. Cl.[2] ..... B65D 47/12

[58] Field of Search ..... 222/480, 545, 562–563, 222/565, 540; 220/254, 256, 284–285; 215/215, 224, 317, 321

[56] References Cited

UNITED STATES PATENTS

| | | | |
|---|---|---|---|
| 2,024,495 | 12/1935 | Wolfe | 220/284 X |
| 2,355,074 | 8/1944 | Hothersall | 220/284 |
| 2,436,193 | 2/1948 | Bristow | 220/285 X |
| 3,307,602 | 3/1967 | Boster | 220/254 X |
| 3,830,393 | 8/1974 | Schaefer | 215/321 X |
| 3,845,872 | 11/1974 | Towns et al. | 215/317 X |
| R4,615 | 10/1871 | Tripp | 222/562 |

FOREIGN PATENTS OR APPLICATIONS

| | | | |
|---|---|---|---|
| 1,336,862 | 7/1963 | France | 220/284 |
| 730,412 | 5/1932 | France | 220/254 |

*Primary Examiner*—Robert B. Reeves
*Assistant Examiner*—Charles A. Marmor

[57] ABSTRACT

A child resistant dispensing container end closure is disclosed which includes a one-piece cap and a one-piece lid removably secured to the cap. The cap includes several openings for dispensing the contents of the container, and the lid covers the openings to prevent dispensing when the lid is in place on the cap. The cap includes an axially recessed center portion, and an annular safety wall encircles the recessed center portion. The lid is frictionally secured in the recess, and an outer peripheral wall and outer peripheral corner of the lid closely confront the safety wall of the cap about their entire annular extent. This limits access to the peripheral wall and peripheral corner of the lid so that the lid cannot be grasped and removed by a child.

5 Claims, 5 Drawing Figures

Fig. 1
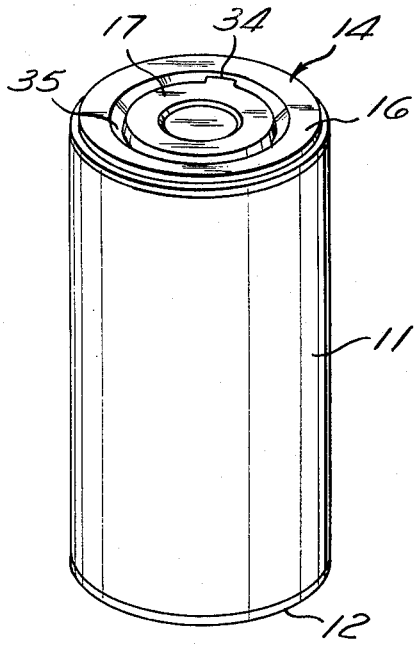
Fig. 2
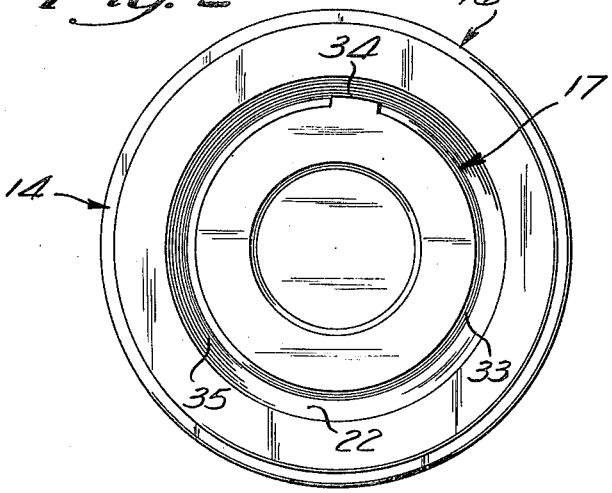
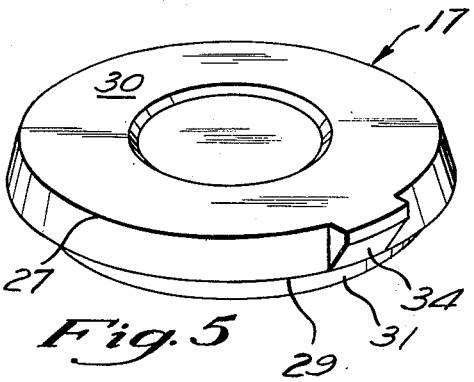
Fig. 5
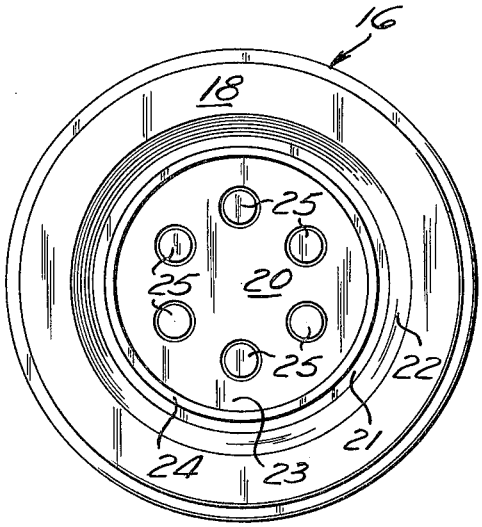
Fig. 3
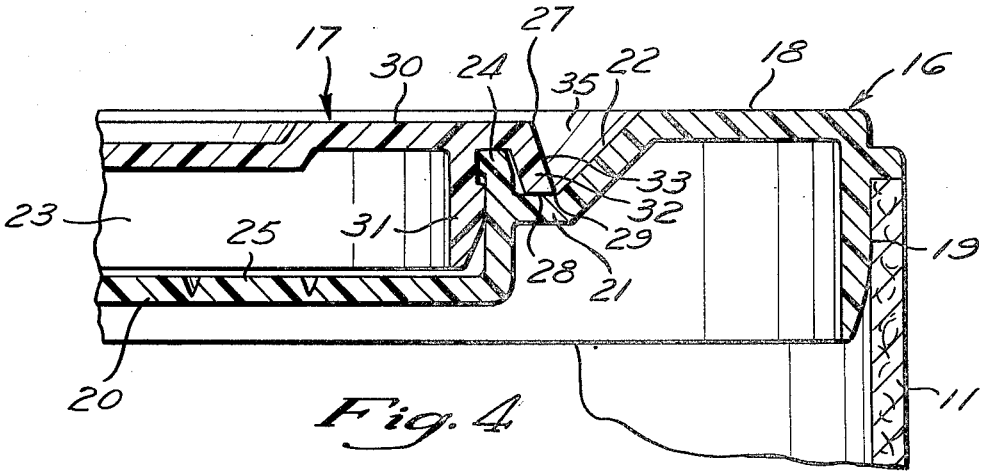
Fig. 4

SAFETY CLOSURE WITH REMOVABLE LID FOR CONTAINERS

BACKGROUND AND SUMMARY OF THE INVENTION

This invention relates generally to end closures for containers, and more specifically to plastic end closures which are child resistant or difficult for small children to open and which are suitable for containers containing insecticides, detergents, drain cleaners, and other household products which might be harmful if ingested.

Plastic end closures for containers may include a one-piece plastic lid which is snapped over the opening of the container as shown in U.S. Pat. No. 3,830,393. The container for this prior art safety closure is deformable to expose a bottom edge of the lid for removing the lid. The bottom edge which is so exposed is then lifted upwardly to remove the lid from the deformable container. Another prior art plastic end closure is shown in U.S. Pat. No. 2,961,132.

The end closure according to the present invention includes a stationary cap and a removable lid frictionally secured to the cap. The lid includes a generally flat round cover wall and an annular peripheral wall extending axially from the cover wall and terminating at a free edge. The juncture of the annular peripheral wall and the annular free edge define an annular peripheral bottom outside corner of the lid.

The cap includes an annular peripheral wall and a dispensing wall having openings for dispensing the product. The dispensing wall is axially recessed from the peripheral wall, and an annular safety wall extends axially between the peripheral wall and the dispensing wall. The dispensing wall and the safety wall cooperatively define an open ended recess in the cap.

The lid is received within the recess in the cap, and the annular safety wall of the cap closely confronts the annular peripheral wall and the annular peripheral outside corner of the lid about their entire annular extent. This limits access to the annular peripheral wall and to the annular peripheral outside corner of the lid so that removal of the lid from the cap by a child is prevented. As used herein, the word child refers particularly to a child whose age is less than 4 years.

BRIEF DESCRIPTION OF THE DRAWINGS

These and other aspects of the invention are incorporated in the preferred embodiment of the invention shown in the drawings, wherein:

FIG. 1 is a perspective view of a container and end closure according to the principles of the invention;

FIG. 2 is an enlarged top view of the end closure shown in FIG. 1, with the lid secured on the cap;

FIG. 3 is a view similar to FIG. 2 but with the lid removed from the cap;

FIG. 4 is an enlarged cross-sectional view of a portion of the cap and lid shown in FIG. 2; and FIG. 5 is a perspective view of the lid.

DETAILED DESCRIPTION OF THE DRAWINGS

Referring now to the drawings in greater detail, FIG. 1 is a perspective view of a dispensing container having an end closure according to the principles of the invention. The dispensing container shown in FIG. 1 is particularly adapted for use with household products which might be harmful if ingested and includes a paper fiber tube 11 and a bottom end closure 12. A top end closure 14 closes the top end of the container during shipping and storage and provides a means for dispensing the contents of the container. The end closures 12 and 14 in the preferred embodiment are secured on the ends of the fiber tube 11 by glue. In actual use, one of the end closures is first secured on the fiber tube 11 to form an open ended can, the can which is so formed is filled with a product which is to be dispensed, and the other end closure is then secured on the open end of the can.

FIGS. 2 through 5 show the top end closure 14 in greater detail. The end closure 14 includes a stationary cap 16 and a removable lid 17 which is frictionally retained on the cap 16. The cap 16 and the lid 17 are each injection molded and are preferably made of a suitable polypropylene. However, any other suitable material as may be readily selected by those skilled in the art may also be used for the cap 16 and the lid 17.

As best shown in FIGS. 3 and 4, the cap 16 includes a generally flat annular peripheral top wall 18 which extends radially outwardly to an outer peripheral container engaging wall 19 which secures the cap 16 on the fiber tube 11. The cap 16 also includes a central dispensing wall 20 disposed radially inwardly from and surrounded by the peripheral wall 18. The central dispensing wall 20 is axially recessed into the interior of the container, and a connecting wall 21 extends between and connects the peripheral wall 18 and the axially recessed central dispensing wall 20.

The connecting wall 21 includes a conical safety wall 22 facing radially inwardly and axially away from the interior of the container. The connecting wall 21 and the central dispensing wall 20 of the cap 16 cooperatively define a central recess or cavity 23 in the cap 16 for receiving the lid 17 in a manner described below. The connecting wall 21 also includes an axially extending flange having a radially inwardly projecting annular tongue portion 24 which cooperates with the lid 17 to frictionally secure the lid 17 on the cap 16 in a manner described below.

The central dispensing wall 20 includes six circumferentially spaced push-out tabs 25. Each tab 25 is defined by a reduced thickness tearing web in a well-known manner so that the tabs 25 seal the container against leakage or contamination during shipping and storage. The tabs 25 are pushed axially into the interior of the container when the product in the container is to be dispensed.

The structural details of the lid 17 are best shown in FIGS. 4 and 5. The lid 17 includes a cover wall 30 which extends coextensively with the central dispensing wall 20 of the cap 16. The cover wall 30 is slightly recessed at its center, and the recessed portion is provided with a label (not shown in the drawings) which contains instructions for the removal of the lid 17. The lid 17 also includes a cylindrical inner skirt portion 31 and a cylindrical outer skirt portion 32 extending from the cover wall 30 axially in a direction toward the interior of the container. The inner skirt portion 31 includes an annular groove which is arranged to receive the annular tongue 24 in the manner shown in FIG. 4. The outer diameter of the skirt portion 31 is greater than the inner diameter of the tongue 24, so that the tongue 24 snaps into the groove and frictionally locks the lid 17 on the cap 16 to prevent removal except by a strong axial force in a direction away from the interior of the container.

The outer skirt portion 32 provides a conical peripheral wall 33 which extends axially from the cover wall 30 and which terminates at a free edge 28. The juncture of the peripheral wall 33 and the free edge 28 defines an annular peripheral bottom outside corner 29, and the juncture of the peripheral wall 33 and the cover wall 18 defines an annular peripheral top outside corner 27. The peripheral wall 33 of the lid 17 faces radially outwardly and axially in a direction away from the interior of the container, and the peripheral wall 33 of the lid 17 closely confronts the safety wall 22 of the cap 16.

The peripheral wall 33 of the lid 17 also includes a lifting surface 34. When the lid 17 is assembled on the cap 16, the lifting surface 34 provides the only exposed surface on the lid 17 which faces in a direction toward the interior of the container so that it can be acted upon by a force in a direction away from the interior of the container to lift the lid off of the container.

When the lid 17 is assembled on the cap 16, the entire lid 17 is received within the recess 23 of the cap 16. In this position, the conical safety wall 22 of the cap 16 and the conical peripheral wall 33 of the lid 17 closely confront one another and cooperatively define an annular V-shaped cavity 35. The cavity 35 is dimensioned and arranged to prevent the entry of a finger of a child into the cavity 35 to prevent the peripheral wall 33 and the outside corner 29 from being grasped to remove the lid 17. Additionally, because the lifting surface 34 is disposed adjacent the cavity 35, the cavity 35 provides the only access to the lifting surface so that the user's hand cannot act upon the lifting surface 34 to remove the lid. In this regard, the open end of the V-shaped cavity 35 is less than ¼ inch wide, and in the preferred embodiment is only ⅛ inch wide. Still further, as best seen in FIG. 4, the cover wall 30 of the lid 17 is axially recessed from the wall 18 of the cap 16 a sufficient distance to preclude grasping of the top peripheral outside corner 27.

To remove the lid 17 from the cap 16, a tool or utensil or other suitable object is inserted through the cavity 35 and is positioned against the lifting surface 34. The tool or utensil then exerts a force against the lifting surface 34 in a direction away from the interior of the container to remove the lid 17 from the cap 16. When the container is first used, the tabs 25 are pushed in a direction into the container to open the holes in the dispensing wall 20, and the container is inverted to dispense a portion of the product. The lid 17 is then repositioned on the cap 16 and pushed in a direction toward the interior of the container to snap the tongue 24 into its associated groove to prevent removal of the lid by a child in the manner explained above.

What is claimed is:

1. In combination, a container and a child resistant molded plastic end closure, said container having an interior at least partially filled with a product to be dispensed, and said end closure being disposed on one end of said container, said end closure comprising a one-piece stationary cap and a one-piece removable lid; said cap and said lid each including detent means frictionally securing said lid to said cap and permitting removal of said lid from said cap only by an axial force exerted on said lid in a direction away from said interior of said container; said lid including a generally flat round lid cover wall and an annular lid peripheral wall extending axially from said cover wall and terminating at an annular free edge, the juncture of said lid peripheral wall and said annular free edge defining an annular peripheral bottom outside corner of said lid, the juncture of said lid cover wall and said lid peripheral wall defining an annular peripheral top outside corner of said lid; said cap including an annular cap peripheral wall, a cap dispensing wall having at least one opening for dispensing said product from said container, said cap dispensing wall being axially spaced from said cap peripheral wall into said interior of said container, a cap connecting wall extending axially from said cap peripheral wall to said cap dispensing wall, said cap connecting wall including an annular safety wall, and said cap connecting wall and said cap dispensing wall cooperatively defining an open ended cylindrical recess in said cap; said lid being received within said recess, said annular safety wall of said cap closely confronting said lid peripheral wall about its entire annular extent to limit access to said lid peripheral wall, said peripheral bottom outside corner of said lid engaging said annular safety wall of said cap about its entire annular extent to prevent access to said bottom outside corner of said lid and to said annular free edge of said lid; said annular peripheral wall of said lid and said annular safety wall of said cap cooperatively defining an open ended annular groove, said annular groove being dimensioned and arranged to prevent a finger of a child from entering said groove and contacting said lid peripheral wall means on said annular peripheral wall of said lid disposed in said groove for receiving an axial lifting force in a direction away from said interior of said container and said annular safety wall of said cap being conical and facing radially inwardly and axially away from said interior of said container.

2. The combination defined by claim 1 wherein said annular peripheral wall of said lid is conical and faces radially outwardly and axially in a direction away from said interior of said container, and said annular groove is V-shaped.

3. In combination, a container and a child resistant molded plastic end closure, said container having an interior at least partially filled with a product to be dispensed, and said end closure being disposed on one end of said container, said end closure comprising a one-piece stationary cap and a one-piece removable lid; said cap and said lid each including detent means frictionally securing said lid to said cap and permitting removal of said lid from said cap; said lid including a generally flat round lid cover wall and an annular lid peripheral wall extending axially from said cover wall and terminating at an annular free edge, the juncture of said lid peripheral wall and said annular free edge defining an annular peripheral bottom outside corner of said lid, the juncture of said lid cover wall and said lid peripheral wall defining an annular peripheral top outside corner of said lid; said cap including an annular cap peripheral wall, a cap dispensing wall having at least one opening for dispensing said product from said container, said cap dispensing wall being axially spaced from said cap peripheral wall into said interior of said container, a cap connecting wall extending axially from said cap peripheral wall to said cap dispensing wall, said cap connecting wall including an annular safety wall, and said cap connecting wall and said cap dispensing wall cooperatively defining an open ended cylindrical recess in said cap; said lid being received within said recess, said annular safety wall of said cap closely confronting said lid peripheral wall about its entire annular extent to limit access to said lid peripheral wall, said peripheral bottom outside corner of said lid engaging said annular safety wall of said cap about its entire annular extent to prevent access to said bottom outside corner of said lid and to said annular free edge of said lid; said annular peripheral wall of said lid and said annular safety wall of said cap cooperatively defining an open ended annular groove, said annular groove being dimensioned and arranged to prevent a finger of a child from entering said groove and contacting said lid peripheral wall, said annular peripheral wall of said lid including a lifting surface disposed in said groove and spaced axially from said free edge, said lifting surface facing axially in a direction toward said interior of said container, said lifting surface being the only accessible surface on said lid facing in a direction toward said interior of said container, and said lifting surface being constructed and arranged to receive said force in a direction away from said interior of said container to remove said lid.

4. In combination, a container and a child resistant molded plastic end closure, said container having an interior at least partially filled with a product to be dispensed, and said end closure being disposed on one end of said container, said end closure comprising a one-piece stationary cap and a one-piece removable lid, said cap and said lid each including detent means frictionally securing said lid to said cap and permitting removal of said lid from said cap only by an axial force exerted on said lid in a direction away from said interior of said container; said lid including a generally flat round lid cover wall and an annular lid peripheral wall extending axially from said cover wall and terminating at an annular free edge, the juncture of said lid peripheral wall and said annular free edge defining an annular peripheral bottom outside corner of said lid, the juncture of said lid cover wall and said lid peripheral wall defining an annular peripheral top outside corner of said lid; said cap including an annular cap peripheral wall, a cap dispensing wall having at least one opening for dispensing said product from said container, said cap dispensing wall being axially spaced from said cap peripheral wall into said interior of said container, a cap connecting wall extending axially from said cap peripheral wall to said cap dispensing wall, said cap connecting wall including an annular safety wall, and said cap connecting wall and said cap dispensing wall cooperatively defining an open ended cylindrical recess in said cap; said lid being received within said recess; said lid peripheral wall and said annular safety wall of said cap cooperatively defining an open ended annular groove, said annular groove being dimensioned and arranged to prevent a finger of a child from entering said groove and contacting said lid peripheral wall, said lid peripheral wall including a lifting surface disposed in said groove and spaced axially from said lid free edge, said lifting surface facing axially in a direction toward said interior of said container, said lifting surface being the only accessible surface on said lid facing in a direction toward said interior of said container, said lifting surface being constructed and arranged to receive said force in a direction away from said interior of said container to remove said lid; said annular safety wall of said cap closely confronting said lid peripheral wall about its entire annular extent to limit access to said lid peripheral wall, said peripheral bottom outside corner of said lid engaging said annular safety wall of said cap about its entire annular extent to prevent access to said bottom outside corner of said lid and to said annular free edge of said lid, whereby said axial force cannot be exerted on said annular peripheral bottom outside corner of said lid and on said annular free edge of said lid and removal of said lid from said cap by a child is prevented.

5. In combination, a container and a child resistant molded plastic end closure, said container having an interior at least partially filled with a product to be dispensed, and said end closure being disposed on one end of said container, said end closure comprising a one-piece stationary cap and a one-piece removable lid; said cap and said lid each including detent means frictionally securing said lid to said cap and permitting removal of said lid from said cap only by an axial force exerted on said lid in a direction away from said interior of said container; said lid including a generally flat round lid cover wall and an annular lid peripheral wall extending axially from said cover wall and terminating at an annular free edge, the juncture of said lid peripheral wall and said annular free edge defining an annular peripheral bottom outside corner of said lid, the juncture of said lid cover wall and said lid peripheral wall defining an annular peripheral top outside corner of said lid; said cap including an annular cap peripheral wall, a cap dispensing wall having at least one opening for dispensing said product from said container, said cap dispensing wall being axially spaced from said cap peripheral wall into said interior of said container, a cap connecting wall extending axially from said cap peripheral wall to said cap dispensing wall, said cap connecting wall including an annular safety wall, and said cap connecting wall and said cap dispensing wall cooperatively defining an open ended cylindrical recess in said cap; said lid being received within said recess; said lid peripheral wall and said annular safety wall of said cap cooperatively defining an open ended annular groove, said annular groove being dimensioned and arranged to prevent a finger of a child from entering said groove and contacting said lid peripheral wall, said annular safety wall of said cap being conical and facing radially inwardly and axially away from said interior of said container, said lid peripheral wall being conical and facing radially outwardly and axially in a direction away from said interior of said container, whereby said annular groove is V-shaped; said annular safety wall of said cap closely confronting said lid peripheral wall about its entire annular extent to limit access to said lid peripheral wall, said peripheral bottom outside corner of said lid engaging said annular safety wall at the bottom of said V-shaped groove about its entire annular extent to prevent access to said bottom outside corner of said lid and to said annular free edge of said lid, and means on said annular peripheral wall of said lid disposed in said groove for receiving an axial lifting force in a direction away from said interior of said container, whereby removal of said lid from said cap by a child is prevented.

* * * * *